United States Patent [19]

Carmes

[11] Patent Number: 4,842,225

[45] Date of Patent: Jun. 27, 1989

[54] DEVICE FOR OPERATING A RAILROAD SWITCH

[75] Inventor: Francis Carmes, Voisins le Bretonneux, France

[73] Assignee: Alsthom, Paris Cedex, France

[21] Appl. No.: 189,873

[22] Filed: May 3, 1988

[30] Foreign Application Priority Data

May 5, 1987 [FR] France ..... 87 06315

[51] Int. Cl.[4] ..... E01B 7/02

[52] U.S. Cl. ..... 246/439; 246/435 R; 246/452

[58] Field of Search ..... 246/415 R, 420, 435 R, 246/438, 439, 448, 452

[56] References Cited

FOREIGN PATENT DOCUMENTS 0176830 4/1986 European Pat. Off. ..... 246/435 R
0684347 11/1939 Fed. Rep. of Germany ..... 246/448
0738149 7/1943 Fed. Rep. of Germany ..... 246/452

*Primary Examiner*—Andres Kashnikow
*Assistant Examiner*—Timothy Newholm
*Attorney, Agent, or Firm*—Sughrue, Mion, Zinn, Macpeak and Seas

[57] ABSTRACT

An operating device for a railroad switch, the device comprising a right drive rod (5) connected to a right point blade (1), a left drive rod (6) connected to a left point blade (2), and a moving carriage (7) driven by a motor between a right locking plate (12) and a left locking plate (13). The plate is held in position by a frame (36). The right drive rod (5) is situated between the right locking plate (12) and the carriage (7) and being received in a right groove (14) of the carriage. The left drive rod (6) is situated between the left locking plate (13) and the carriage (7) by being received in a left groove (15) of the carriage. Each drive rod (5, 6) is provided with two floating pegs (8 to 11) extending perpendicularly to the grooves and each is received in a corresponding notch (16 to 19) in the rod. Each locking plate includes at least one vertical locking recess (20, 21) having sloping side walls, and the width of the carriage between the locking plates comprising: at each end, a first step (22, 22A) of width no greater than the distance L between the two locking plates less twice the diameter D of a floating peg; followed on each side of the carriage going axially towards the middle of the carriage by a second step (23, 23A) of width lying between L-2D and L-D; and finally by a middle step (24) of width less than L and greater than the width of the second step, with each transition between a first step and a second step taking place via a sloping wall.

12 Claims, 8 Drawing Sheets

1
2
3
4
5
6
7
12
13
20
21
28
29
70A 3
2
4
1
18
10
19
33
31
30
X2
X1
80
70
11
34
7
35
32
36

DEVICE FOR OPERATING A RAILROAD SWITCH

The present invention relates to a device for operating a railroad switch.

BACKGROUND OF THE INVENTION

Several systems of operating and locking mechanisms for railroad switches or "points" exist in various different countries and depending on the functions that are to be performed, in particular on whether the switch is capable of being burst open or "trailed". A switch which is capable of being trailed is one which, when used as a trailing switch, i.e. when approached from the direction having two tracks leading to a single track, passes traffic, without damage, coming from the track which does not correspond to the direction in which the switch is set, with the switch then being displaced by axle thrust. When a switch is approached by traffic coming from the single track and going towards one of the plurality of different tracks, the switch is said to be a facing switch. A switch includes two moving blades, referred to as a right point blade and as a left point blade. The terms "right" and "left" correspond to the positions of the point blades as seen when the switch is approached as a facing switch. One of the blades touches its corresponding backing rail, while the other blade is at a distance from its backing rail.

French switches are not trailable, whereas the switches on German lines are trailable. French switches which are used as trailing switches only or which are used as facing switches at speeds not exceeding 40 km/h, have a motor system including an guide plate and drive wheel system internal to the motor for locking the switch in each of its two positions. For switches used as facing switches at speeds in excess of 40 km/h, French railways make use, in addition, of an external, direct-action locking system for each blade individually, with such locking systems being known in France as "carter-coussinet" locks. These systems have only one drive rod actuating both the right and the left point blades.

German switches are trailable. One prior operating mechanism with internal locking includes an outlet shaft provided with two special gear wheels each meshing with the rack of a corresponding drive rod.

One of the drive rods is connected to the right point blade and the other is connected to the left point blade. The touching blade is locked by means of a locking bar which penetrates, at the end of outlet shaft rotation and at the end of drive rod displacement, in a notch provided in the drive rod of the touching blade. The mechanism is reversible when trailed, by acting on the non-locked non-touching blade which is held in place by a force from a torque limiter.

The object of the present invention is to provide a modular switch-operating device which is capable of being adapted to all kinds of function: trailable or not trailable, and regardless of the operating strokes of the blades. Said device is much simpler than the system having internal guide plate and drive wheel locking, or external locking by means of case-chair locks, or than the German trailable systems having special gear wheels and racks used with locking bars and notches. Finally, it is more robust and it provides greater safety than any existing system.

SUMMARY OF THE INVENTION

The present invention thus provides a device for operating a railroad switch constituted by two moving blades, namely a right point blade and a left point blade, with one of the blades touching and the other blade not touching the associated respective backing rail, with at least the touching blade being locked in position, the device comprising a right drive rod perpendicularly connected to the right point blade in the vicinity of its tip, a left drive rod perpendicularly connected to the left point blade in the vicinity of its tip, and axial drive motor means for said drive rods, wherein the device further comprises a carriage driven in axial translation by said motor means, said carriage being axially movable between a right locking plate and a left locking plate which are mutually parallel to the axes of said drive rods, said plates being held by a frame, the right drive rod being situated between the right locking plate and said carriage by being at least partially received in a right longitudinal groove of said carriage, the left drive rod being situated between the left locking plate and said carriage by being at least partially received in a left longitudinal groove of said carriage, each drive rod being provided with two cylindrical vertical floating pegs extending perpendicularly to said longitudinal grooves and each received in a notch provided in the rod, each locking plate including at least one vertical locking recess having sloping side walls flaring apart on going from the plate towards the rod, and having a depth which is not greater than one-half of the diameter of one of said floating pegs, and wherein the width of said carriage between the two locking plates is stepped over three distinct widths, comprising: at each end, a first step whose width is not greater than the distance L between the two locking plates less twice the diameter D of a floating peg; followed on each side of the carriage going axially towards the middle of the carriage by a second step having a width lying between L-2D and L-D; and finally a central step whose width is less than L and greater than the width of said second step; the transition between the first step and the second step taking place via a sloping wall, and with the distance between the two notches of a drive rod being not less than the length of the central step plus twice the width of a second step, and being not greater than the length of the central step plus the length of a second step plus the length of a first step.

If it is desired that the switch be trailable from only one of the two trailing tracks, for example on turn-out tracks for cross-overs on single-track both-way lines, one of the two locking plates includes both of said vertical locking recesses.

When a non-trailable switch is required, both the right and the left locking plates includes both of said locking recesses.

Said motor means are preferably reversible.

The term "reversible" is used below in this specification and also in the claims to designate the fact that the motor, of whatever kind, when not powered, can be driven as a receiver, for example by applying a force to the non-locked drive rod which is connected to a point which is being subjected to a force to burst it open.

In another embodiment of the invention, applicable to a switch in which both the right and the left point blades are connected to a single drive rod, and which is non-trailable, i. e. where both the right and the left point blades are lockable, the device includes a carriage axially movable between a locking plate and a fixed guide wall which are fixed to a frame, said drive rod being situated between the locking plate and the carriage and being at least partially received in a longitudinal ,groove of the carriage, said drive rod being provided with two cylindrical vertical floating pegs extending perpendicularly to said longitudinal groove and each being received in a notch provided in the rod, the locking plate including two vertical recesses having sloping side walls flaring away from the bottom of the recess towards its opening, with the depth of the recess being no greater than one-half the diameter of a floating peg, and wherein the width of the gap between said locking plate and said carriage is stepped over three distinct levels, comprising: at each end of the carriage, a first gap of size X1 equal to not less than the diameter D of one of said floating pegs; followed on each side thereof going axially towards the middle of the carriage by a second gap of size X2 which is less than D and not less than $\frac{1}{2}$D; and finally in the middle of the length of the carriage by a third gap which is less than the gap of size X2, with the transition between the gap of size X1 to the gap of size X2 taking place via a sloping vertical wall of the carriage, the distance between the two notches of the drive rod being not less than the length of the central portion of the carriage for which said gap is less than X2, plus the total length of the two portions of the carriage for which said gap is equal to X2, and is less than the length of said central portion plus the length of one of the two portions of the carriage for which said gap is X2 plus the length of one of the two portions of the carriage for which said gap is X1, said carriage being associated with motor means for driving it in axial translation.

In both embodiments, having one or two drive rods, each floating peg advantageously includes, at each of its ends outside said notches, a wheel which co-operates with said locking plate by rolling thereover.

The, or each, locking plate may include an abutment in the immediately downstream vicinity of one of said notches in the direction of carriage displacement towards said notch for preventing floating peg overshoot.

Each floating peg is advantageously held axially in position by a collar fixed to the peg, said collar being greater diameter than the peg and penetrating firstly in a longitudinal groove of the locking plate associated with the peg under consideration, and secondly in an enlarged portion of said peg receiving notch in the drive rod.

Advantageously, the motor means include a ballscrew having its nut connected to said carriage, with the ballscrew being rotated by a motor and stepdown gear unit via a torque limiter.

BRIEF DESCRIPTION OF THE DRAWINGS

Embodiments of the invention are described by way of example with reference to the accompanying drawings, in which.

MORE DETAILED DESCRIPTION

The essential components of a switch-operating device in accordance with the invention, and the operation thereof, are now described with reference to FIGS. 1A to 1E.

Figure 1A:
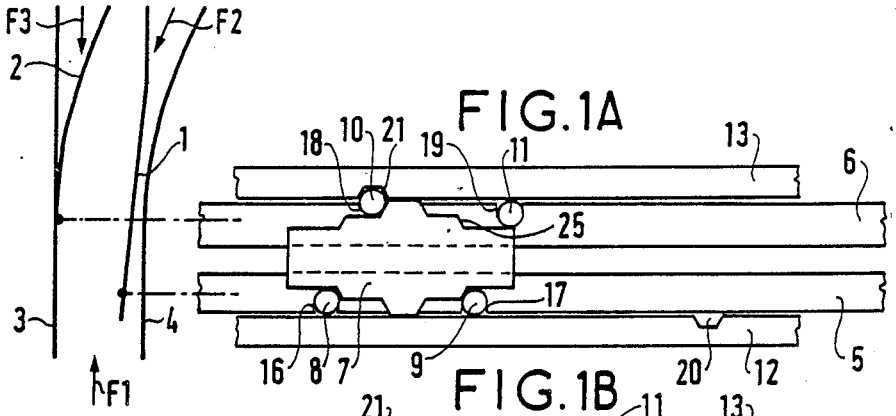
FIGS. 1A to 1E are diagrams showing the operation of a trailable, two drive rod switches in accordance with the invention; these figures also serve to describe the principle on which the invention is based and to describe its essential components.
Figure 1B:
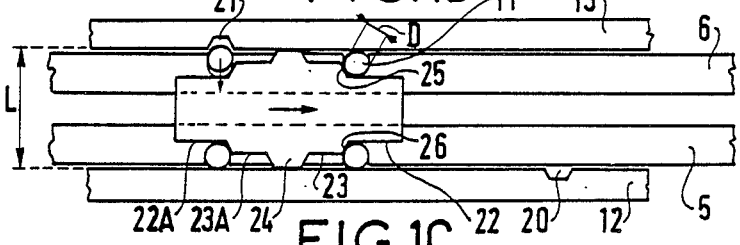
Figure 1C:
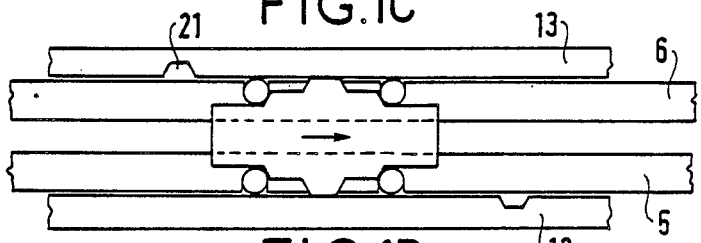
Figure 1D:
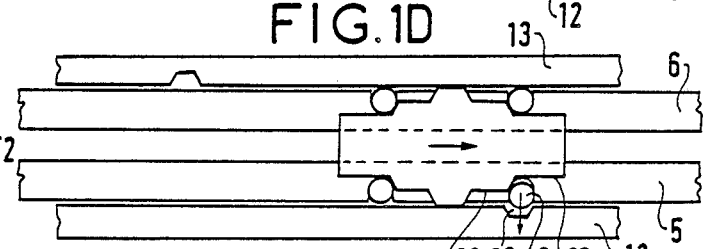
Figure 1E:
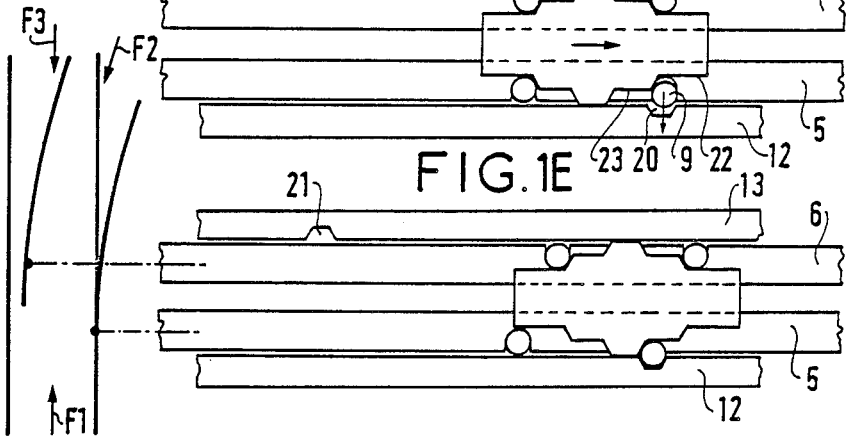

FIGS. 1A and 1E show a switch in diagrammatic form to the left of the operating device. This switch comprises a right point blade 1, a left point blade 2, a straight track backing rail 3, and a turn-out track backing rail 4. In FIG. 1A, the switch is in a position corresponding to traffic coming from or going to the turn-out track.

Figure 2A:
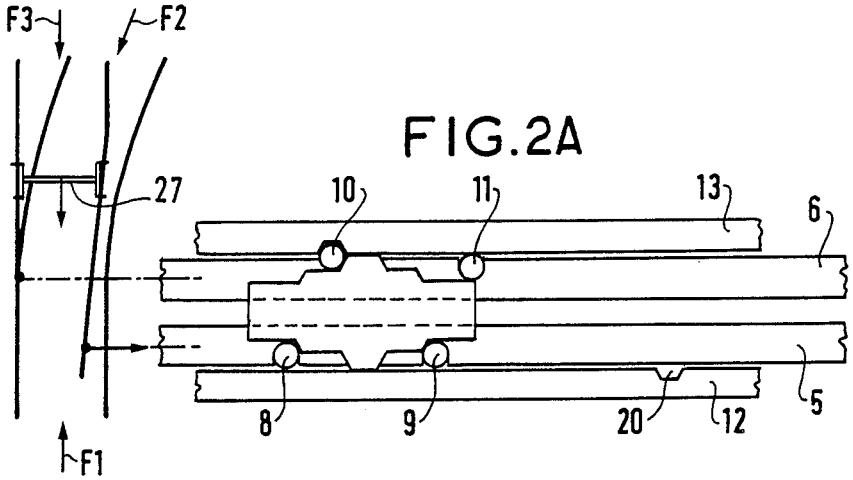
FIGS. 2A to 2C correspond to a switch-operating device as shown in FIGS. 1A to 1E, and they show how the switch operates when it is trailed.
Figure 2B:
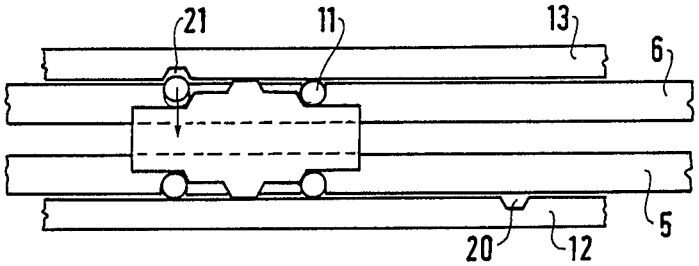
Figure 2C:
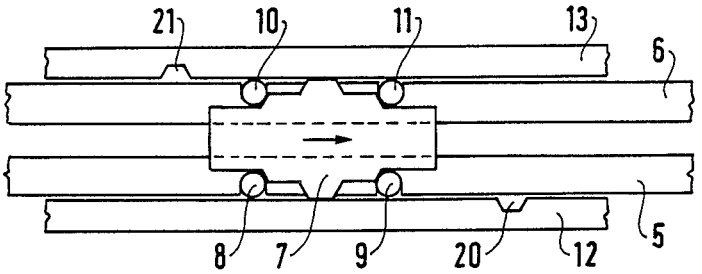
Figures 3A, 3B, 3C, 3D, 3E:
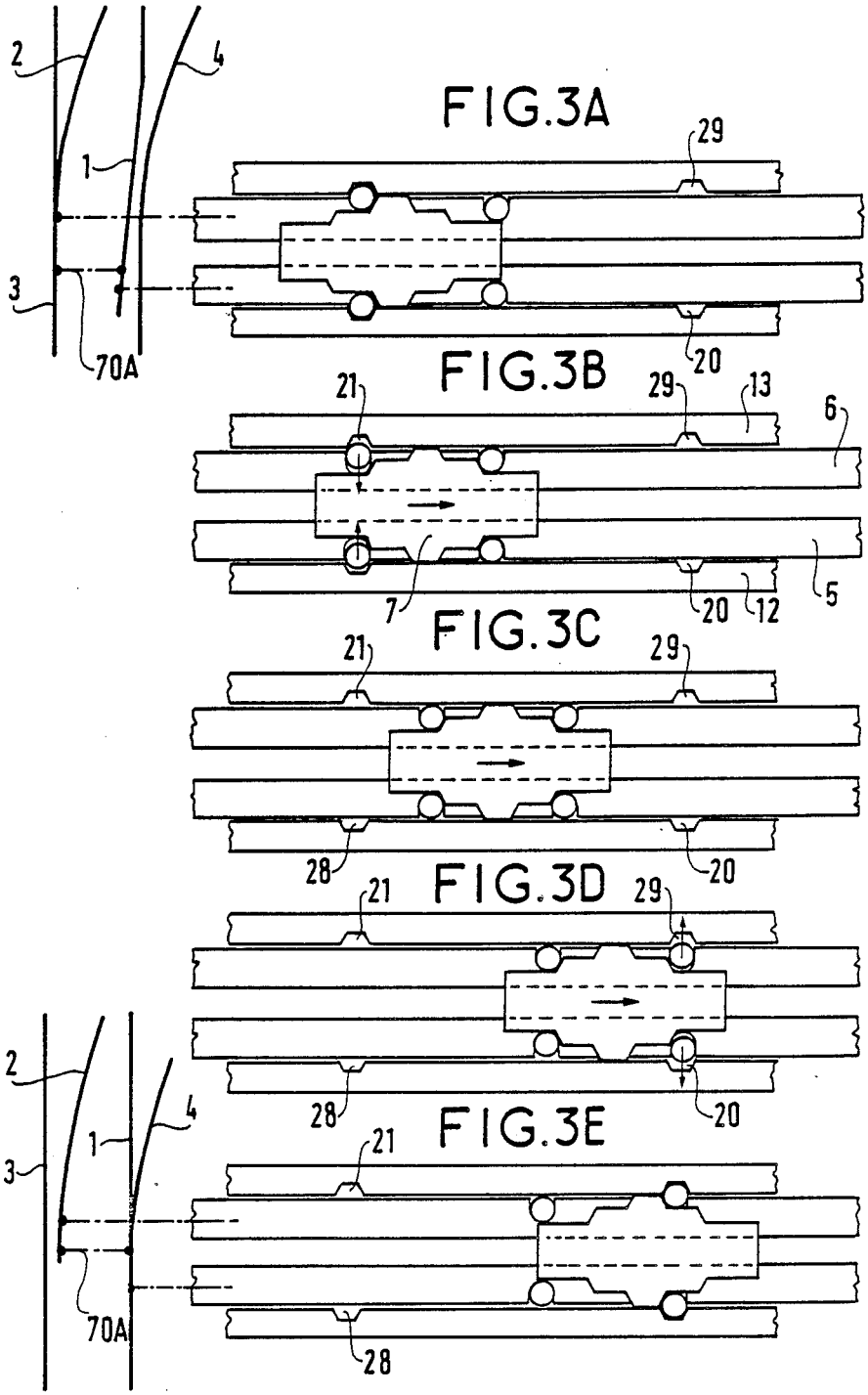
FIGS. 3A to 3E are similar to FIGS. 1A to 1E, but for a non-trailable switch.
Figures 4A, 4B, 4C, 4D, 4E:
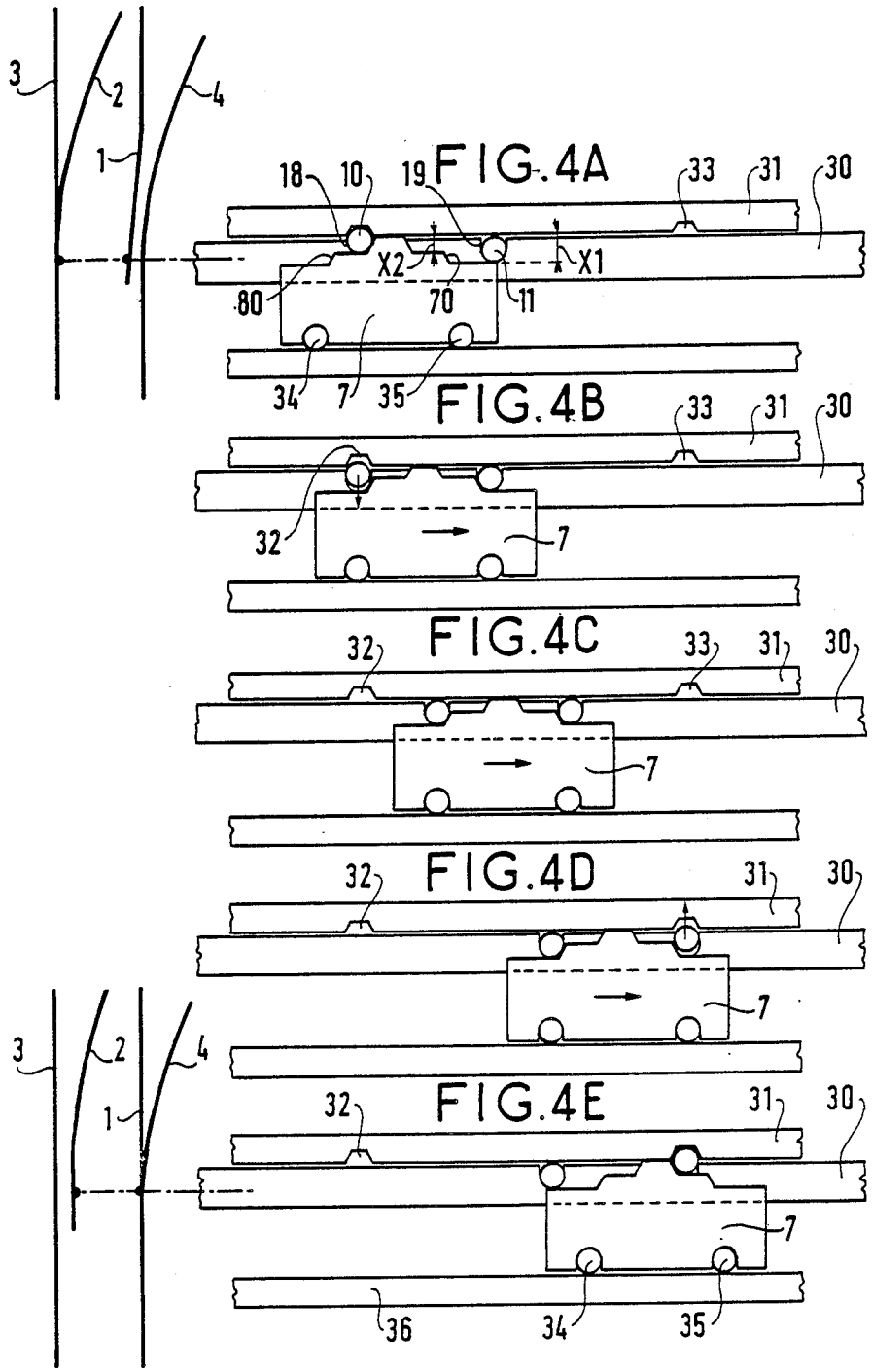
FIGS. 4A to 4E are similar to FIGS. 1A to 1E and 3A to 3E but for a non-trailable switch-operating device having a single drive rod.

In contrast, in FIG. 1E, the switch is in a position which corresponds to traffic running along the straight track. The switch is switched from on position to the other by displacing both the right and the left point blades, with the non-touching right blade 1 becoming the touching blade and the touching left blade 2 becoming the non-touching blade. In FIG. 1A, traffic travelling in the direction of arrow F1 takes the switch as a facing switch, traffic travelling in the direction of arrow F2 takes the switch as a trailing switch, and finally traffic travelling in the direction of arrow F3 must burst open or "trail" the switch. The switch is said to be "trailable" if traffic passing over it in the direction of arrow F3 causes no damage, with the switch switching over from the turn-out position to the straight position under the pressure applied by the axle on the non-touching right blade 1. This type of operation is possible with the operating device shown in FIGS. 1A to 1E, and its operation is shown in FIGS. 2A to 2C.

In FIG. 1E, the direction of travel shown by arrow F2 is the direction which must burst open the switch, whereas travel direction F3 merely encounters a trailing switch.

The switch-operating device includes a right drive rod 5 connected perpendicularly to the right point blade 1 in the vicinity of its tip, and a left drive rod 6 connected perpendicularly to the left point blade 2 in the vicinity of its tip. These two drive rods are capable of being moved axially by motor means (not shown in these figures) via a carriage 7 which is driven in axial translation by said motor means, and via floating pegs 8, 9, 10, and 11.

As can be seen in the figures, each drive rod is provided with two such pegs.

The carriage 7 is driven axially between a right locking plate 12 and a left locking plate 13 which are rigidly fixed within a frame, not shown. The right drive rod 5 is situated between the right locking plate 12 and the carriage 7, and is at least partially received in a right longitudinal groove 14 (see FIGS. 6 and 8) in which it is capable of sliding.

Figure 5:
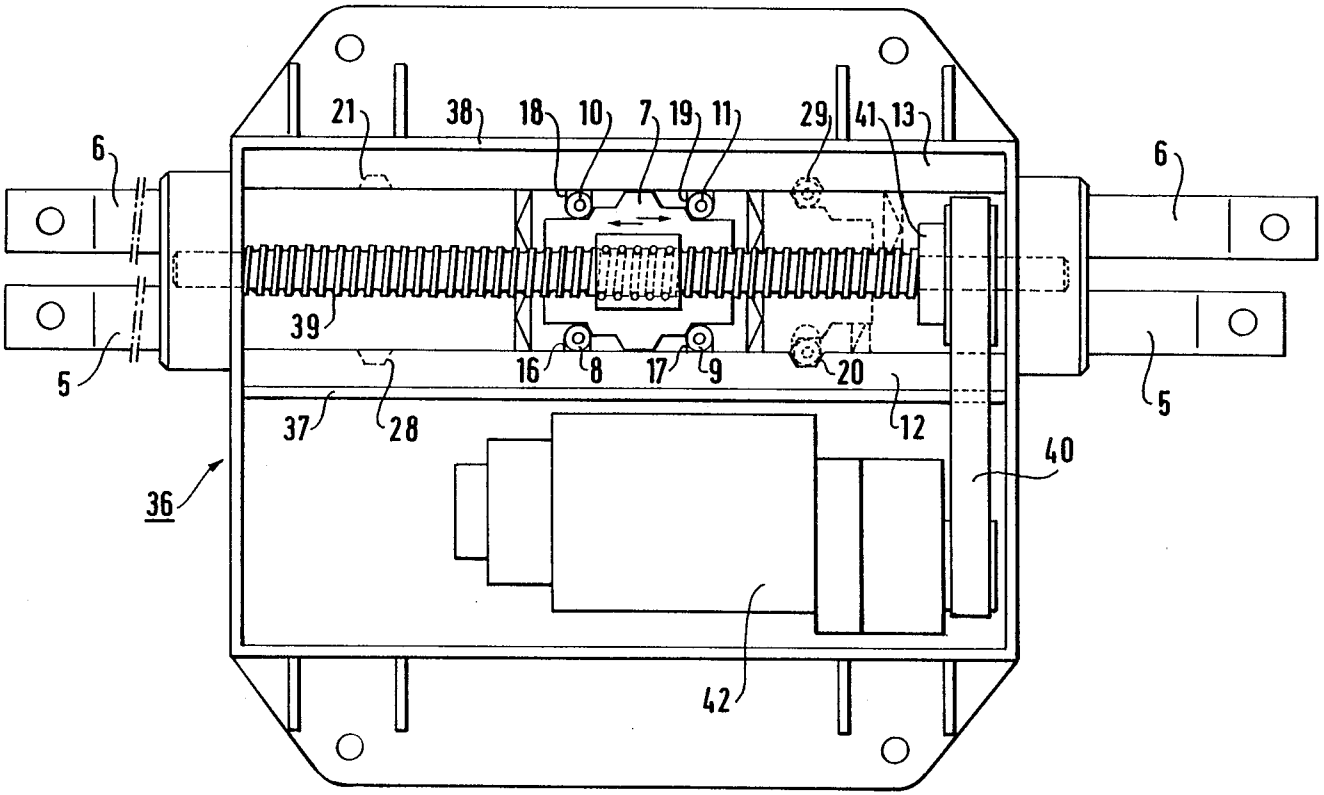
FIG. 5 is a simplified plan view of a switch-operating device in accordance with the invention.

Similarly, the left drive rod 6 is situated between the left locking plate 13 and the carriage 7 and is at least partially received in a left longitudinal groove 15 (FIGS. 5 and 8) in which it is capable of sliding.

Each cylindrical floating peg 8 to 11 is disposed vertically, i.e. perpendicularly to the longitudinal grooves 14 and 15 of the carriage 7 in a corresponding notch 16 to 19 of the drive rod. Thus, each peg is prevented from moving in the axial direction of the drive rod and is thus constrained to move with the drive rod by virtue of the corresponding notch, and it is held in place laterally between the carriage and the corresponding locking plate.

The right locking plate 12 has a vertical locking recess 20 with sloping side walls which flare from the bottom of the recess to its opening. Similarly, the left locking plate 13 includes a vertical locking recess 21 with sloping walls.

As shown in the figures, the width of the carriage 7 is stepped over three distinct widths beginning at each end with a first step 22, 22A whose width is equal to the distance L between the two locking plates 12 and 13 less twice the diameter D of a floating peg 8 to 11.

This first step is followed at each end going towards the middle of the carriage by a second step 23 or 23A whose width lies between L-2D and L-D, and finally there is a center step 24 whose width is greater than that of the second step and is not greater than L. Further, the depths of the recesses 20 and 21 is not greater than a $\frac{1}{2}$D. Finally, the distance between two notches such as 16 and 17 on the same drive rod is not less than the length of the central step 24 plus the lengths of the two second steps 23 and 23A, and not more than the length of the central step 24 plus the length of one of the second steps 23 or 23A plus the length of one of the first steps 22 or 22A, in such a manner that, as shown in FIG. 1A, both floating pegs 10 and 11 always remain situated between the carriage and the corresponding locking plate.

Operation is as follows:

In FIG. 1A, floating peg 10 is received both in its notch 18 in the left drive rod 6, and in locking recess 21 in the left locking plate 13, and it cannot escape therefrom since the second step 23A of the carriage prevents it from doing so. The left drive rod 6 is thus locked in both directions with any axial force that may be applied thereto being transformed via the floating peg 10 into transverse and longitudinal forces on the locking plate 13 which is fixed to the frame, without any longitudinal force being applied to the carriage 7.

When a change of direction operating instruction is given, motor means act on the carriage 7 which moves to the right, see FIG. 1B.

When the first step 22A is situated level with the peg 18, the peg is free to escape from the recess 21. At this moment, the sloping face 25 of the passage between the first step 22 and the second step 23 bears against the floating peg 11 and thus also against the left drive rod 6 via the notch 19, thereby driving the drive rod 6. The peg 10 is thus obliged to leave the recess 21 by virtue of the sloping wall of the recess 21.

The right drive rod 5 is also driven by the peg 9 and the sloping face 26 (FIG. 1B).

FIG. 1C: the assembly comprising the carriage 7, and the bars 5 and 6 is moved axially.

FIG. 1D: the peg 9 arrives level with the recess 20 and an abutment 45 (not visible in these figures but visible in FIG. 6) prevents the peg 9 from going any further, thereby causing the peg to be received in the recess 20 thus enabling the carriage 7 to continue its stroke with the step 23 overlapping the floating peg 20. The position shown in FIG. 1E is finally reached, with the right drive rod being locked in place and with the switch having changed position and giving access to the straight track.

In FIGS. 1A to 1E, only one drive rod is locked at a time: the left drive rod 6 is locked in FIG. 1A, and the right drive rod 5 is locked in FIG. 1E.

For example, in FIG. 1A, neither of the two pegs 8 or 9 is received in the recess 20, thus a force applied to the right point blade 1 is capable of driving the carriage 7 to the right, thereby enabling the switch to be trailed. This is shown in FIGS. 2A to 2C. In these figures, 27 represents the leading axle of a vehicle which i trailing the switch.

These three FIGS. 2A to 2C show the switch being thrown the other way.

FIGS. 3A to 3E are identical to FIGS. 1A to 1E, but they relate to a switch which is not trailable, and in which both point blades, i.e. both the non-touching blade and the touching blade are locked in both of their switching positions. To this end, the right locking plate 12 has two locking recesses 20 and 28. Similarly, the left locking plate 13 has two locking recesses 21 and 29. In this case, the two point blades are connected to each other by a tie-bar 70A.

Finally, FIGS. 4A to 4E show a variant in which the switch-operating device has its right and left point blades 1 and 2 interconnected and driven by a single drive rod 30. In this case, the switch is not trailable and includes only one locking plate 31 having two locking recesses 32 and 33.

Opposite, the carriage 7 merely has wheels 34 and 35 which run against the frame 36 and which serve to guide the carriage.

In these figures,the depths of the recesses 32 and 33 is similarly not greater than one-half of the diameter D of the floating pegs 10 and 11. Further, the gap between the locking plate 31 and the carriage 7 is stepped to three levels: at each end there is a first gap X1 which is not less than the diameter D of the pegs; then there is a second gap a $\frac{1}{2}D<X2<D$; and finally in the middle of the carriage there is a gap which is less than X2 . The transitions between the gaps X1 and X2 take place via sloping walls 70 and 80.

Returning to FIGS. 3A to 3E, it is also possible to provide a switch which is trailable in one of its two positions and non-trailable in the other. In this case, only one of the two locking plates has two locking recesses, while the other one has only one locking recess.

This may be applicable, for example, to switches on turnout tracks for cross-overs on both-way single tracks.

FIGS. 5 to 8 show a practical embodiment of a device in accordance with the invention, and in particular of a device having two drive rods 5 and 6.

Figure 6:
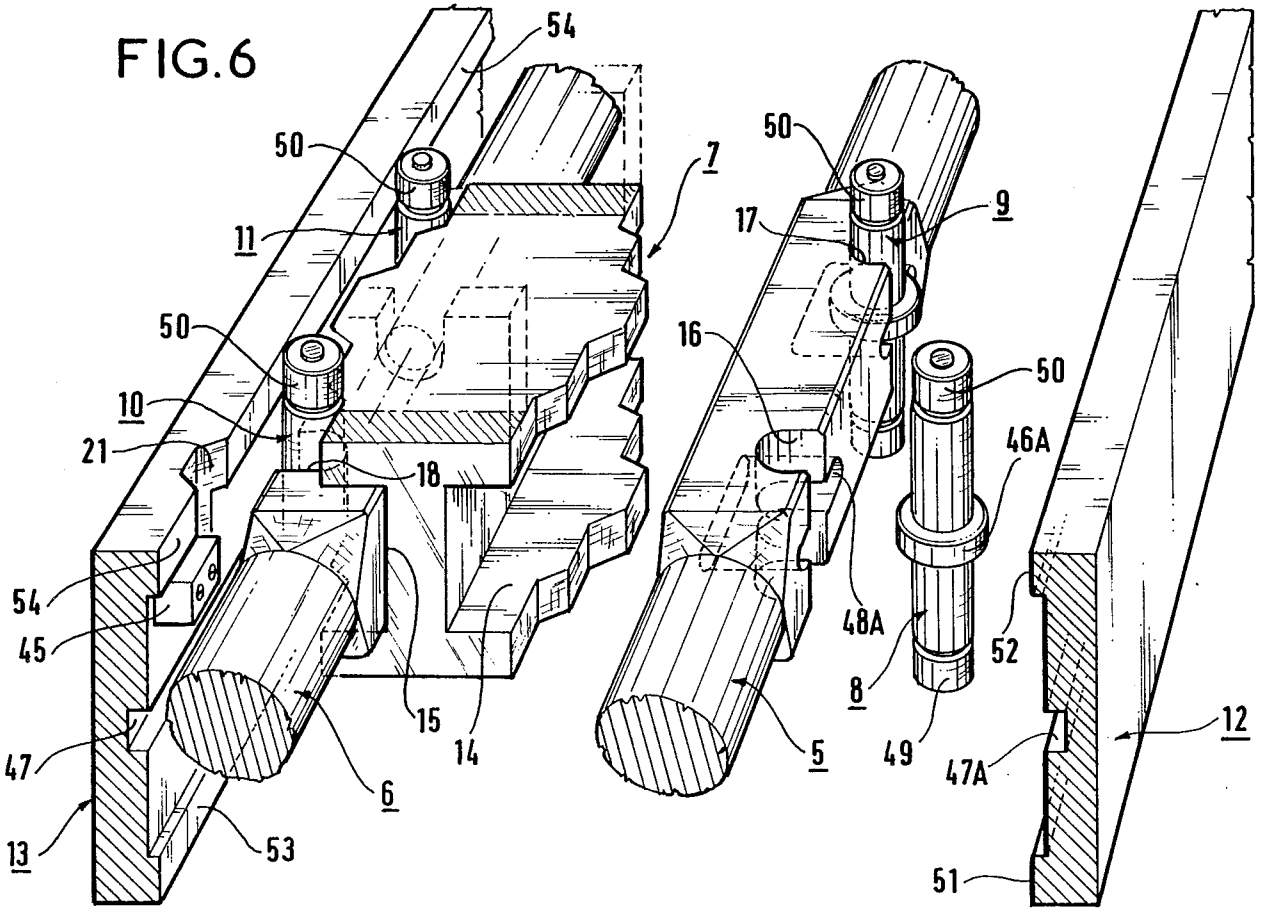
FIG. 6 is a partially exploded perspective view of the essential components of the device, with the motor means and the frame being omitted.

FIG. 6 is a simplified overall plan view. It shows the right drive rod 5, the left drive rod 6, and the right and left locking plates 12 and 13 held in place by a frame 36 between cross members 37 and 38. In the example shown in FIG. 5, each of the locking plates has two locking recesses 20 and 28 and 21 and 29 respectively.

As can be seen in the figure, the drive rods 5 and 6 project from the frame 36 in both directions so that the device can be placed equally well on one side or the other of the track, or even between the two rails.

The carriage 7 and the floating pegs 8, 9, 10, and 11 together with their notches 16, 17, 18, and 19 can also be seen.

The carriage 7 is driven axially by a ballscrew 39 which is rotated by a motor and stepdown gear unit 40 via a torque limiter 41 and a toothed belt 40. The ballscrew 39 drives the carriage 70 by means of its two-part nut 43, 44 (see FIG. 8) which is fixed to the carriage 7.

FIG. 6 is an exploded perspective view of the carriage 7, or more particularly of a portion of the carriage 7 with the top portion of the carriage carrying the two-part nut 43, 44 being omitted, but with the right drive rod 5, the left drive rod 6, the two locking plates 12 and 13, and the four floating pegs 8, 9, 10, and 11 being shown.

In this figure,it can be seen that the locking recess 21 includes an anti-overshoot abutment 45 which is downstream from said recess in the carriage advance direction and which serves to oblige the peg 10 to engage in the recess 21. The other recesses (not shown in this figure) are likewise each provided with such respective anti-overshoot abutments.

Figure 8:
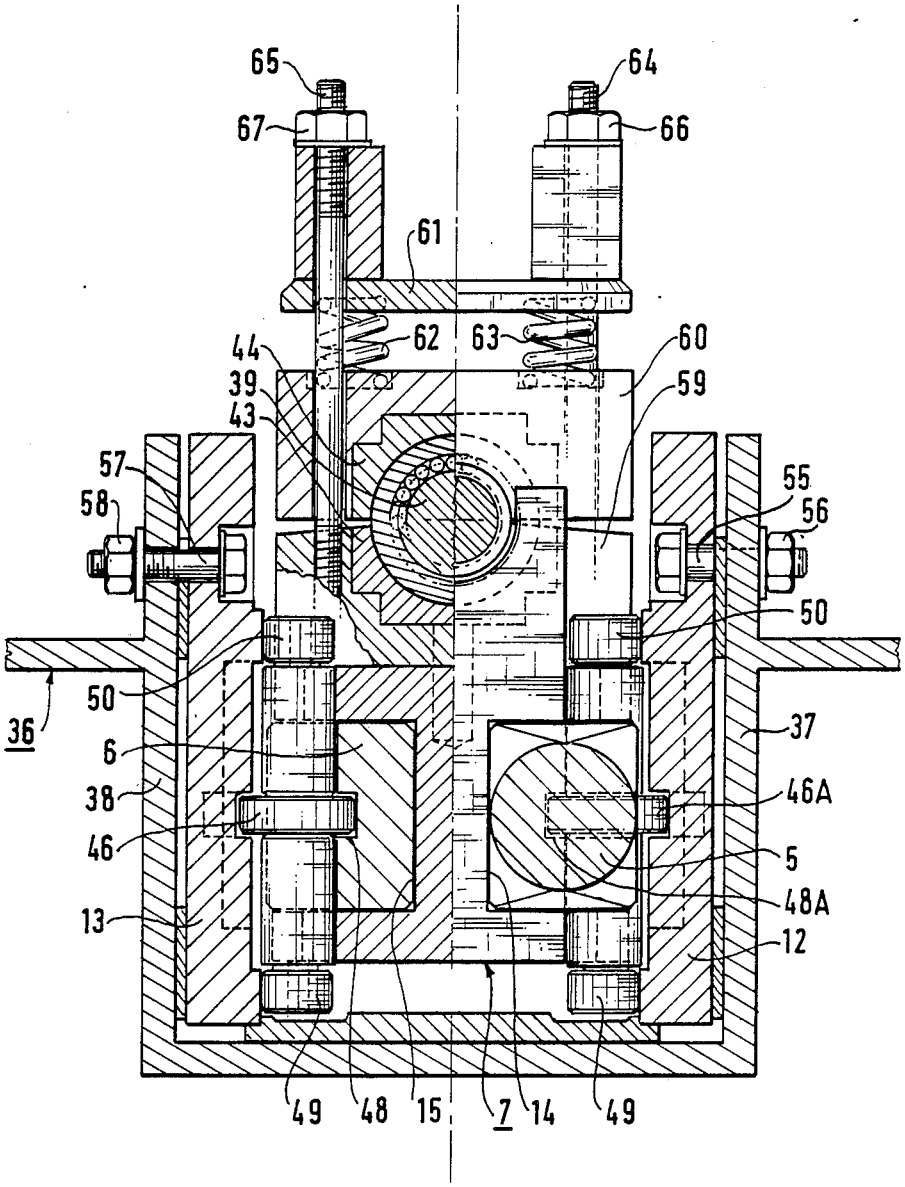
FIG. 8 is a section view on VIII—VIII of FIG. 7 in which the top portion of the figure concerning the ballscrew drive mechanism has the section stepped back in the direction VIII A and up to the axis.

As shown in the figure, and also in FIG. 8, each floating peg is held axially, i.e. vertically, by a collar 46, 46A which penetrates firstly into a longitudinal groove 47, 47A in the associated locking plate, and secondly in enlarged portions 48, 48A of the peg-receiving notches 16 to 19 in the drives rods 5 and 6.

Finally, each floating peg includes a running wheel 49, 50 at each of its ends for the purpose of running over a corresponding running path 51, 52, 53, or 54 standing proud on locking plate 12 or 13.

Thus, in addition to their function of driving and locking the drive rods, these floating pegs also serve to guide the carriage 7.

FIG. 8 shows the locking plates 12 and 13 fixed to the frame 36 by screws and nuts 55, 56, 57, and 58.

In FIG. 8, it can be seen that the two-part nut 44, 43 of the ballscrew 39 is resiliently mounted on the carriage 7 by means of central pieces 59 and 60 which are fixed in the middle of the carriage 7 by resilient means comprising a cap 61, springs 62 and 63, threaded rods 64 and 65, and associated nuts 66 and 67.

Figure 7:
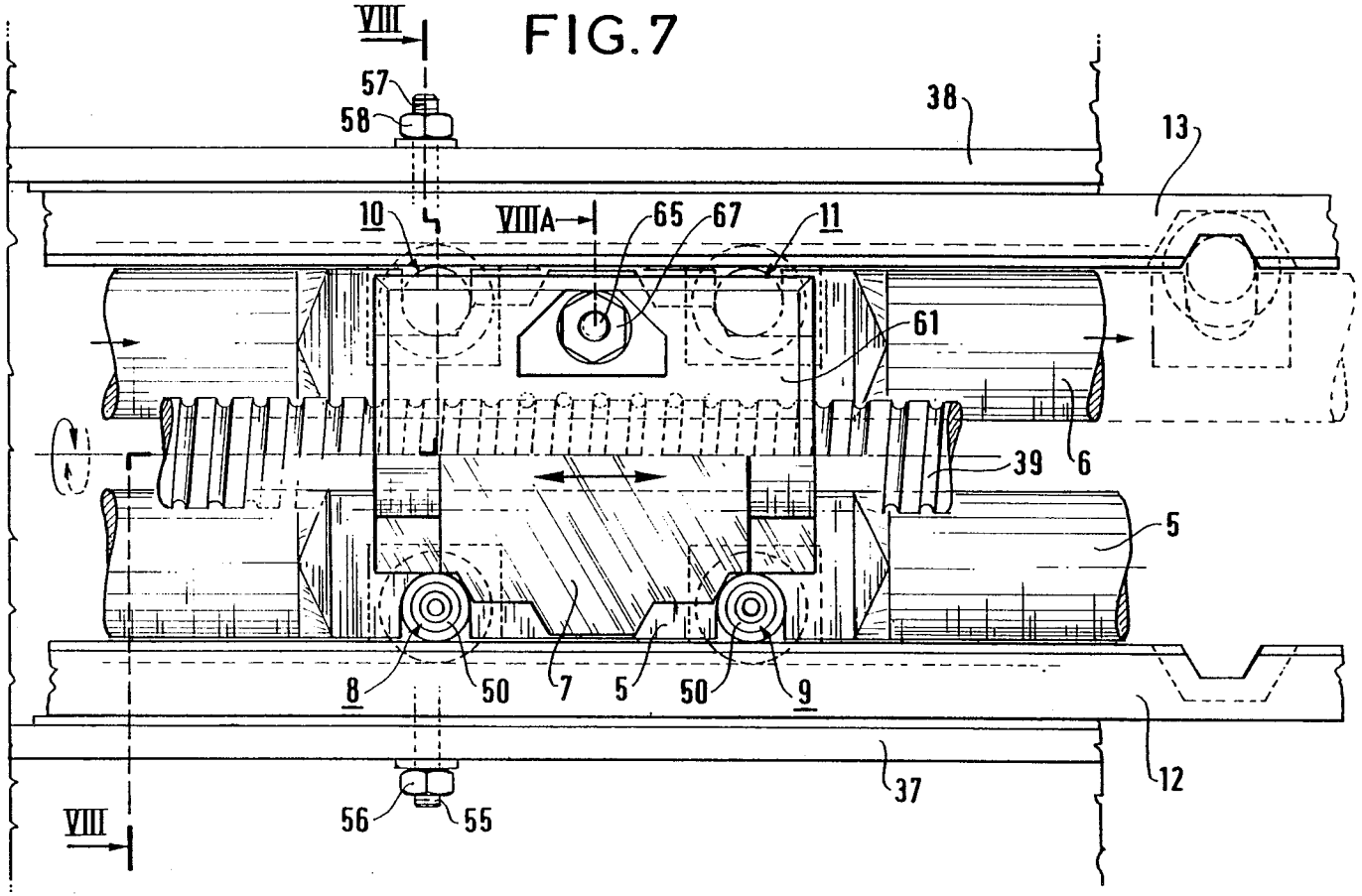
FIG. 7 shows a portion of FIG. 5 in greater detail and on a larger scale; in this plan view, the portion of the figure above the axis shows the ballscrew carriage drive mechanism, whereas the portion situated below the axis has this mechanism omitted to show the carriage on its own.

FIG. 7 shows the same as FIG. 8, but seen from above.

In the bottom portion of FIG. 7, the parts 64, 66, 60, 43, 44, and 59 have been omitted.

As can be seen, the operating device for a railroad switch in accordance with the invention is easily adapted to various different functions.

The only changes resulting from the option selected apply to the locking plates 12 and 13. A trailable switch has only one locking recess per plate, whereas a non-trailable switch has two recesses per plate. Similarly, regardless of the stroke to be performed by the point blades, the equipment used is the same, with the only changes applying to the locking plates for which the locking recesses need to be at various different distances apart.

Further, an advantage of the device consists in using a single common intermediate part: a floating peg is used both for driving the drive rod and also for locking it, and this is not true of any of the current systems where it is perfectly possible to actuate point blades without locking them if just one component of an operating device is broken.

Finally, given that the locking system operates by pinching a floating peg between two other parts, a large shear area is obtained for a small-sized floating peg. The assembly is extremely robust and much more robust than presently existing systems. The parts are simple, and in particular the locking plates and the carriage are parts which are very easily milled.

Naturally, a conventional monitoring system may be associated with this operating device in order to indicate the real positions of the point blades in conventional manner.

I claim:

1. A device for operating a railroad switch constituted by two moving blades, namely a right point blade and a left point blade, with one of the blades touching and the other blade not touching an associated respective backing rail, with at least the touching blade being locked in position, the device comprising a right drive rod perpendicularly connected to the right point blade in the vicinity of its tip, a left drive rod perpendicularly connected to the left point blade in the vicinity of its tip, and axial drive motor means for said drive rods, wherein the device further comprises a carriage driven in axial translation by said motor means, said carriage being axially movable between a right locking plate and a left locking plate which are mutually parallel to the axes of said drive rods, said plates being held by a frame, the right drive rod being situated between the right locking plate and said carriage by being at least partially received in a right longitudinal groove of said carriage, the left drive rod being situated between the left locking plate and said carriage by being at least partially received in a left longitudinal groove of said carriage, each drive rod being provided with two cylindrical vertical floating pegs extending perpendicularly to said longitudinal grooves and each received in a notch provided in the rod, each locking plate including at least one vertical locking recess having sloping side walls flaring apart on going from the plate towards the rod, and having a depth which is not greater than one-half of the diameter of one of said floating pegs, and wherein the width of said carriage between the two locking plates is stepped over three distinct widths, comprising: at each end, a first step whose width is not greater than the distance L between the two locking plates less twice the diameter D of a floating peg; followed on each side of the carriage going axially towards the middle of the carriage by a second step having a width lying between L-2D and L-D; and finally a central step whose width is less than L and greater than the width of said second step; the transition between the first step and the second step taking place via a sloping wall, and with the distance between the two notches of a drive rod being not less than the length of the central step plus twice the width of a second step, and being not greater than the length of the central step plus the length of a second step plus the length of a first step.

2. A switch-operating device according to claim 1, wherein at least one of the two locking plates includes two of said vertical locking recesses.

3. A switch-operating device according to claim 1, wherein each floating peg includes a running wheel at each of its ends, said wheels co-operating with said adjacent locking plate by running thereover outside said recesses.

4. A switch-operating device according to claim 1, wherein each locking plate includes an abutment in the immediate downstream vicinity of one of said recesses, considered relative to the direction of carriage displacement towards said recess, and for the purpose of preventing a floating peg from overshooting.

5. A device according to claim 1, wherein each floating peg is held axially in position by a collar fixed to the peg, said collar being of greater diameter than the peg and penetrating firstly in a longitudinal groove of the locking plate associated with the peg under consideration, and secondly in an enlarged portion of said peg receiving notch in the drive rod.

6. A switch-operating device according to claim 1, wherein said motor means are reversible.

7. A device according to claim 6, wherein said motor means include a ballscrew having its nut connected to said carriage, with the ballscrew being rotated by a motor and stepdown gear unit via a torque limiter.

8. A device for operating a railroad switch constituted by two moving blades, namely a right point blade and left point blade, one of said blades touching and the other of said blades not touching a respective backing rail, both of said blades being locked, and the device including a single driv. rod which is perpendicularly connected to both of said point blades in the vicinity of their respective tips, wherein the device includes a carriage axially movable between a locking plate and a fixed guide wall which are fixed to a frame, said drive rod being situated between the locking plate and the carriage and being at least partially received in a longitudinal groove of the carriage, said drive rod being provided with two cylindrical vertical floating pegs extending perpendicularly to said longitudinal groove and each being received in a notch provided in the rod, the locking plate including two vertical recesses each having sloping side walls flaring away from the bottom of the recess towards its opening, with the depth of the recess being no greater than one-half the diameter of a floating peg, and wherein the width of a gap between said locking plate and said carriage is stepped over three distinct levels, comprising: at each end of the carriage, a first gap of size X1 equal to not less than the diameter D of one of said floating pegs; followed on each side thereof going axially towards the middle of the carriage by a second gap of size X2 which is less than D and not less than $\frac{1}{2}$D; and finally in the middle of the length of the carriage by a third gap which is less than the gap of size X2, with the transition between the gap of size X1 to the gap of size X2 taking place via a sloping vertical wall of the carriage, the distance between the two notches of the drive rod being not less than the length of the central portion of the carriage for which said gap is less than X2, plus the total length of the two portions of the carriage for which said gap is equal to X2, and is less than the length of said central portion plus the length of one of the two portions of the carriage for which said gap is X2 plus the length of one of the two portions of the carriage for which said gap is X1, said carriage being associated with the motor means for driving it in axial translation.

9. A device according to claim 8, wherein each floating peg includes a running wheel at each of its ends, said wheels co-operating with said locking plate by running thereover outside said recesses.

10. A device according to claim 8, wherein the locking plate includes an abutment in the immediate downstream vicinity of one of said recesses, considered relative to the direction of carriage displacement towards said recess, and for the purpose of preventing the floating peg from overshooting.

11. A device according to claim 8, wherein each floating peg is held axially in position by a collar fixed to the peg, said collar being of greater diameter than the peg and penetrating firstly in a longitudinal groove of the locking plate associated with the peg under consideration, and secondly in an enlarged portion of said peg receiving notch in the drive rod.

12. A device according to claim 8, wherein said motor means include a ballscrew having its nut connected to said carriage, with the ballscrew being rotated by a motor and stepdown gear unit via a torque limiter.

* * * * *